US005743228A

United States Patent [19]

Takahashi

[11] Patent Number: 5,743,228

[45] Date of Patent: Apr. 28, 1998

[54] CAMSHAFT DRIVE FOR OUTBOARD MOTOR

[75] Inventor: Masanori Takahashi, Hamamatsu, Japan

[73] Assignee: Sanshin Kogyo Kabushiki Kaisha, Shizuoka-ken, Japan

[21] Appl. No.: 739,881

[22] Filed: Oct. 31, 1996

[30] Foreign Application Priority Data

Oct. 31, 1995 [JP] Japan ..... 7-282866

[51] Int. Cl.[6] ..... F02F 7/00

[52] U.S. Cl. ..... 123/195 P; 123/198 E; 440/77

[58] Field of Search ..... 123/195 C, 198 E, 123/41.7, 195 P; 440/77

[56] References Cited

U.S. PATENT DOCUMENTS 4,126,115 11/1978 List et al. ..... 123/41.7
4,721,485 1/1988 Suzuki ..... 123/195 P
4,878,467 11/1989 Schmidt ..... 123/198 E
4,960,081 10/1990 Atsuumi ..... 123/198 E
5,445,547 8/1995 Furukawa ..... 440/77

*Primary Examiner*—Noah P. Kamen
*Attorney, Agent, or Firm*—Knobbe, Martens, Olson & Bear, LLP

[57] ABSTRACT

A camshaft drive for the engine of an outboard motor includes a drive sprocket mounted to the crankshaft of the engine, a sprocket mounted to each of first and second camshafts, and a drive belt engaging the sprockets, whereby the crankshaft drives the camshafts. A cover extends over the camshaft drive, the cover having an air inlet and air outlet and defining a first cooling air flow path from said air inlet across a first portion of the drive belt pathway for cooling a first portion of the belt, and a second flow path across a second portion of the drive belt pathway to the air outlet for cooling a second portion of the belt.

26 Claims, 8 Drawing Sheets

CAMSHAFT DRIVE FOR OUTBOARD MOTOR

FIELD OF THE INVENTION

The present invention relates to a camshaft drive for an outboard motor, and more particularly, to a camshaft drive in which a crankshaft of the engine drives a pair of camshafts and, optionally, one or more oil pumps, a coolant circulation pump and/or a distributor, and wherein an air cooling system is provided for cooling said camshaft drive.

BACKGROUND OF THE INVENTION

For several reasons, four-cycle engines are receiving renewed interest as potential power plants for outboard motors. The four-cycle engine has several advantages which makes it more desirable than the more compact, higher specific output two-cycle engines normally utilized for these applications. The prime advantage of four-cycle engines is that they have a wider usable power and speed band than two-cycle engines and also they offer the opportunity of better exhaust emission control, particularly when considering the lubrication of the engine.

However, in order to compete with the greater specific performance of a two-cycle engine, it has been generally the practice to employ high-performance variations of four-cycle engines for outboard motor applications. This results in the use of such features as single or multiple overhead cam shafts and other high-performance features.

As is well known and regardless of the engine type, an outboard motor presents a very demanding challenge for the designer. Not only is the space that is available for the engine restricted, the engine is also relatively closely confined within a surrounding protective cowling. Therefore, the cooling of certain engine components and auxiliaries presents particular problems.

This is also true with respect to the cam shaft drive mechanism for a four-cycle engine. A preferred form of cam shaft drive uses a toothed belt or the like for driving the cam shaft. Belt drives have certain advantages over chain drives, the prime one being silence in operation. However, belt driven cam shafts are generally exposed and are not cooled by the lubricating system for the engine as with the case with chain drives.

It is, therefore, a principal object of this invention to provide an improved four-cycle outboard motor embodying an improved cooling system for its cam shaft drive.

It is a further object of this invention to provide an improved four-cycle overhead cam engine embodying an arrangement for simplifying and highly effectively cooling the flexible transmitter drive for the overhead cam shaft or cam shafts.

As is well known, the air for combustion in an outboard motor is normally drawn through an atmospheric air inlet opening in the protective cowling. The design of these air inlet openings is such that they are configured so as to attempt to minimize the amount of water that is drawn into the interior of the protective cowling along with the inducted air. This is particularly important in conjunction with marine environments wherein the surrounding water may contain highly corrosive material such as salt which can be detrimental to the engine. Thus, the induction systems generally somewhat restrict the air flow into the protective cowling and this gives rise to a reduction in the ability to use the intake air flow for cooling purposes.

It is, therefore, a still further object of this invention to provide an improved outboard motor arrangement and cowling air inlet that is configured so that the air that is inducted into the protective cowling will effectively separate water but can be utilized to cool components of the engine such as the cam shaft drive.

It is yet a further object of the invention to provide a camshaft drive which is useful in driving one or more additional engine components, such as a distributor, main and/or secondary oil pump, or a coolant circulation pump.

SUMMARY OF THE INVENTION

In accordance with the present invention, an engine has a block with a first end. An output shaft is journalled with respect to the block, the output shaft having a first end extending from the first end of the block. At least one other shaft which is journalled for rotation with respect to the block has its end extending beyond the first end of the engine. Preferably, first and second camshafts extend from the end of the engine. A flexible belt engages the output shaft and each other shaft extending outwardly of the engine block, whereby the output shaft drives the other shafts.

Means are provided for defining a first air path and second air path for providing cooling air to cool the flexible drive belt. Preferably, the means comprises a cover having an air inlet and air outlet. The cover defines a first cooling air path from said air inlet and across a first portion of the belt pathway, and a second cooling air path across a second portion of the belt pathway to the air outlet.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

Figure 1:
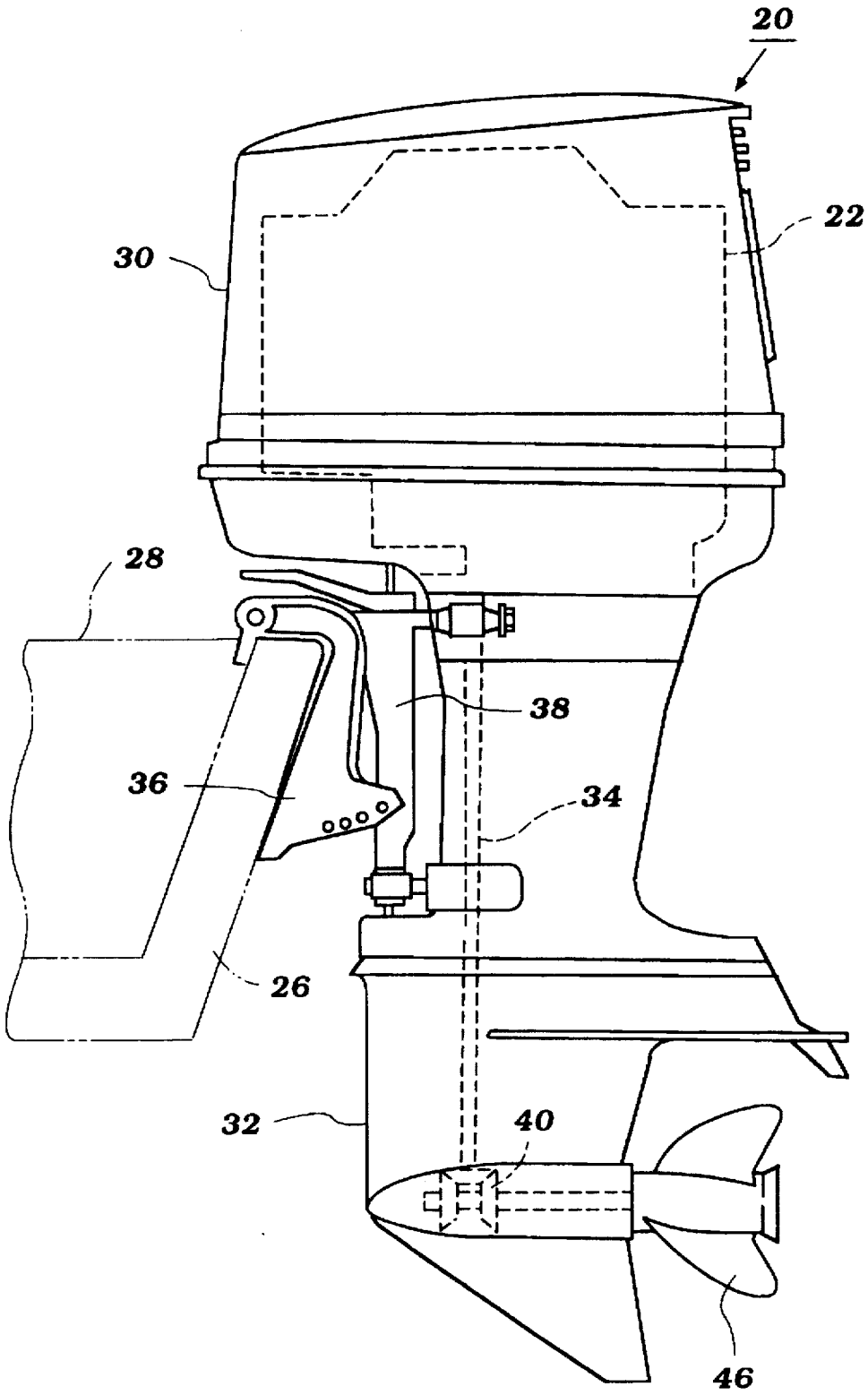
FIG. 1 is a side view of an outboard motor mounted to a watercraft, the outboard motor having an engine mounted in a cowling thereof, the engine powering a propeller.
Figure 2:
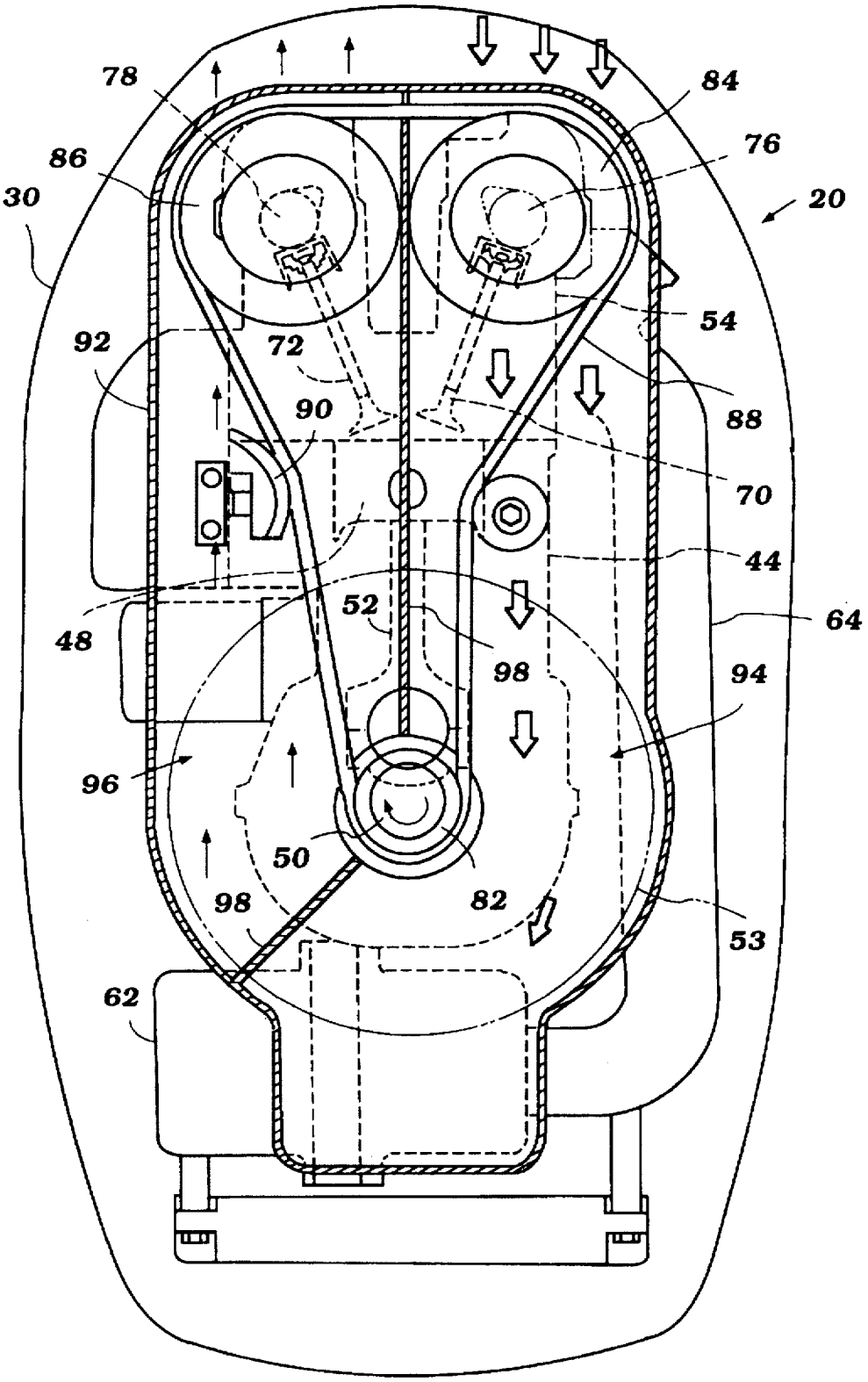
FIG. 2 is a top view of the engine of FIG. 1, illustrating a camshaft drive mechanism of the present invention including a flexible transmitter extending between a crankshaft sprocket and an exhaust camshaft sprocket and an intake camshaft sprocket, and further including a camshaft cooling system including a cover mounted about the camshaft drive mechanism.

FIGS. 1 and 2 illustrate an outboard motor 20 having an engine 22 with a camshaft drive mechanism 24 in accordance with the present invention. As best illustrated in FIG. 1, the outboard motor 20 is preferably mounted to the stem 26 of a watercraft 28. The motor 20 is mounted to the watercraft 28 via a bracket 36. A steering shaft 38 is mounted to the bracket 36 and motor 20 for steering the motor 20.

The outboard motor 20 has a cowling 30 which encloses the engine 22, and a lower drive housing 32 extending downwardly therefrom for enclosing a vertically oriented drive shaft 34. The drive shaft 34 is an extension of the crankshaft or output shaft of the engine 22 and engages a horizontally extending propeller drive 40 for driving a propulsion device, preferably a propeller 42, of the motor 20.

Figure 3:
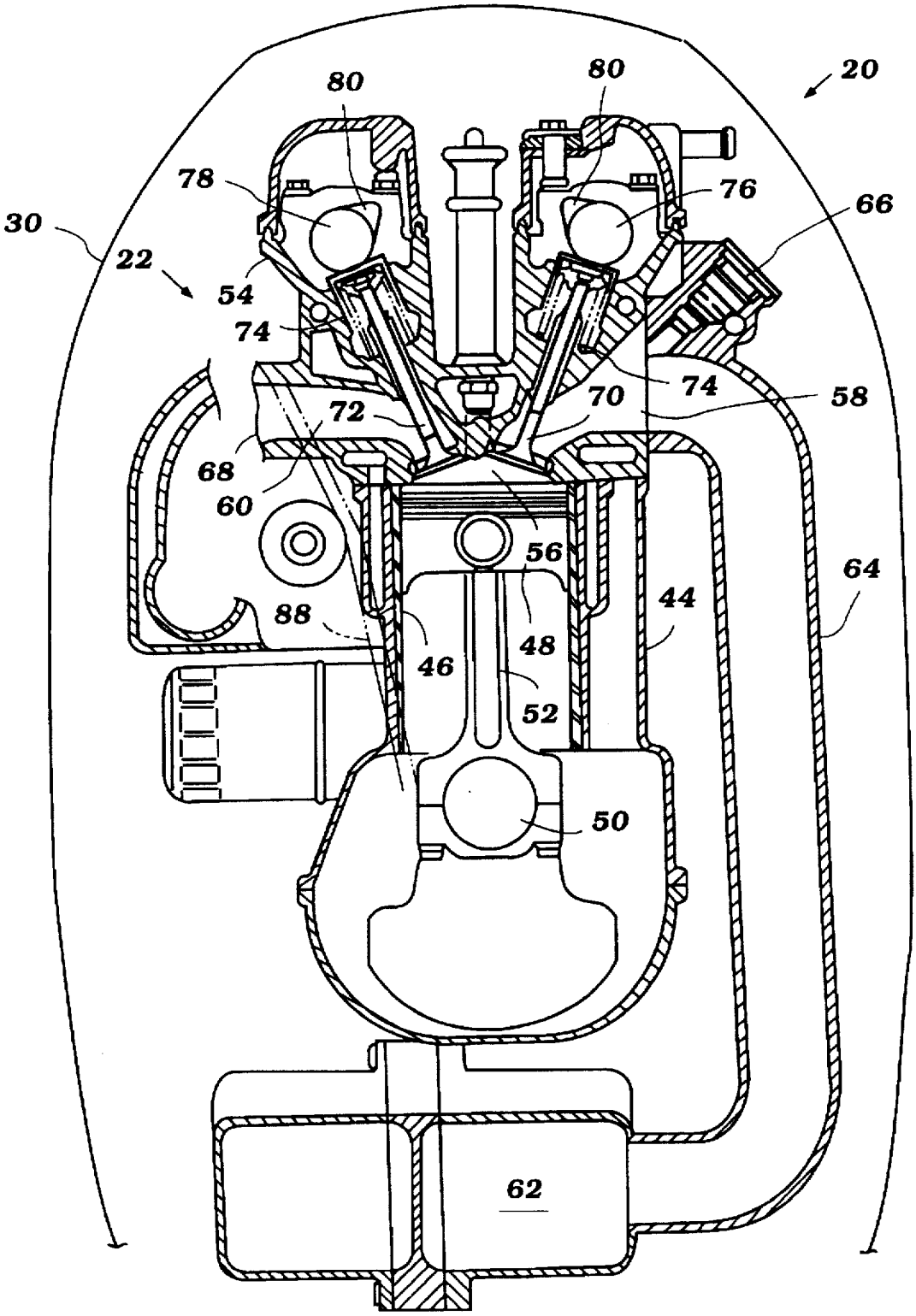
FIG. 3 is a cross-sectional view illustrating the engine of FIG. 2.

The engine 22 which powers the outboard motor 20 is best illustrated in FIGS. 2 and 3. Preferably, the engine 22 is of the four-cylinder, four-cycle, inline variety. It should be understood to those skilled in the art that the camshaft drive mechanism 24 of the present invention is useful with engines of other types, having other numbers of cylinders, and/or having other cylinder arrangements. It should also be understood that while the camshaft drive mechanism 24 of the present invention is most preferably utilized with an engine 22 of this type utilized to power an outboard motor 20 of a watercraft 28, it may be found useful when used with engines 22 adapted to other applications.

The engine 22 has a block 44 containing four cylinders 46. In each cylinder 46 is mounted for reciprocation a piston 48. The pistons 48 are connected to a crankshaft 50 via a connecting rod 52. The engine 22 is oriented within the motor cowling 30 such that the crankshaft 50 extends generally along a vertical axis, with the pistons 48 each reciprocating along a horizontal axis. So oriented, the engine 22 has a top end and a bottom end.

The crankshaft 50 has a second end which extends outwardly of the lower end of the engine 22 and forms the drive shaft 34. The crankshaft 50 has a first end which extends outwardly of the top end of the engine 22. A flywheel 53 and a drive sprocket 82, which is described in more detail below, are both mounted to the first of the crankshaft 50. In accordance with the present invention, it is contemplated that instead of the crankshaft 50 itself extending outwardly beyond the engine that the crankshaft 50 instead drive one or more output shafts which extend beyond the end(s) of the engine 22. Thus, the crankshaft 50 may drive a first output shaft which extends upwardly beyond the first end of the engine 22 for use in driving the camshaft drive of the present invention, and/or that a second output shaft extend downwardly beyond the second end of the engine 22 for use in driving the propulsion device.

Mounted across the otherwise open end of each cylinder 46 is a cylinder head 54. The cylinder head 54 has a number of portions therein for cooperating with each cylinder 46 and forming therewith a combustion chamber 56. An intake passage 58 and exhaust passage 60 extend through the cylinder head 54 corresponding to each cylinder 46.

Air is provided to each intake passage 58 from an air plenum 62 positioned alongside the engine 22. The air plenum 62 is in communication with an intake air manifold 64 having passages leading to each of the intake air passages 58 through the head 54 to the combustion chambers 56.

A charge former 66 is positioned in the air intake passage corresponding to each cylinder 46. The charge former 66 introduces fuel into the incoming air for combustion in the combustion chambers 46.

The exhaust passage 60 corresponding to each cylinder 46 extends in communication with an exhaust manifold 68. The exhaust manifold 68 extends along the length of the engine 22 to an exhaust outlet (not shown).

An intake valve 70 is positioned in each air intake passage 58 and an exhaust valve 72 is positioned in each exhaust passage 60 corresponding to each cylinder 46. Each valve 70,72 has an enlarged base section for seating within the passage 58,60 at the combustion chamber 56. Each valve 70 has a rod-shaped portion extending upwardly into the cylinder head 54.

A spring 74 is connected to each valve 70,72 for biasing the valve into a seated or closed position in which the enlarged portion of the valve obstructs the passage 58,60 at the combustion chamber 56. The end of each intake valve 58 is mounted in direct contact a camshaft. Similarly, each exhaust valve 60 is mounted in direct contact with a camshaft. Preferably, a first camshaft 76 is provided for opening and closing the intake valves 58, and a second camshaft 78 is provided for opening and closing the exhaust valves 60.

The camshafts 76,78 are journalled for rotation with respect to the cylinder head 54. As illustrated, the camshafts 76,78 extend generally parallel to the crankshaft 50 and are spaced apart from one another. The camshafts 76,78 including camming surfaces 80 for opening the respective valves 58,60.

As best illustrated in FIG. 2, the engine 22 includes a camshaft drive mechanism 24. As stated above, a drive sprocket 82 is mounted on the first end of the crankshaft 50 extending from the top of the engine 22. Similarly, a first sprocket 84 is mounted to the end of the first camshaft 76 extending beyond the head 54 at the top of the engine 22, and a second sprocket 86 is mounted to the end of the second camshaft 78 extending beyond the head 54 at the top of the engine 22. The sprockets 84,86 mounted on the camshafts 76,78 are thus positioned on the same end of the engine 22 as the drive sprocket 82 which is mounted on the crankshaft 50. Flexible transmitter means, preferably in the form of a flexible toothed belt 88, extend between the crankshaft sprocket 82 and the first and second camshaft sprockets 82,84. The flexible belt 88 causes the camshafts 76,78 to be driven by the crankshaft 38 of the engine when the engine is running. A belt tensioner 90 is provided for maintaining tension on the belt 88 and keeping the belt in place on the sprockets 82,84,86.

Figure 4:
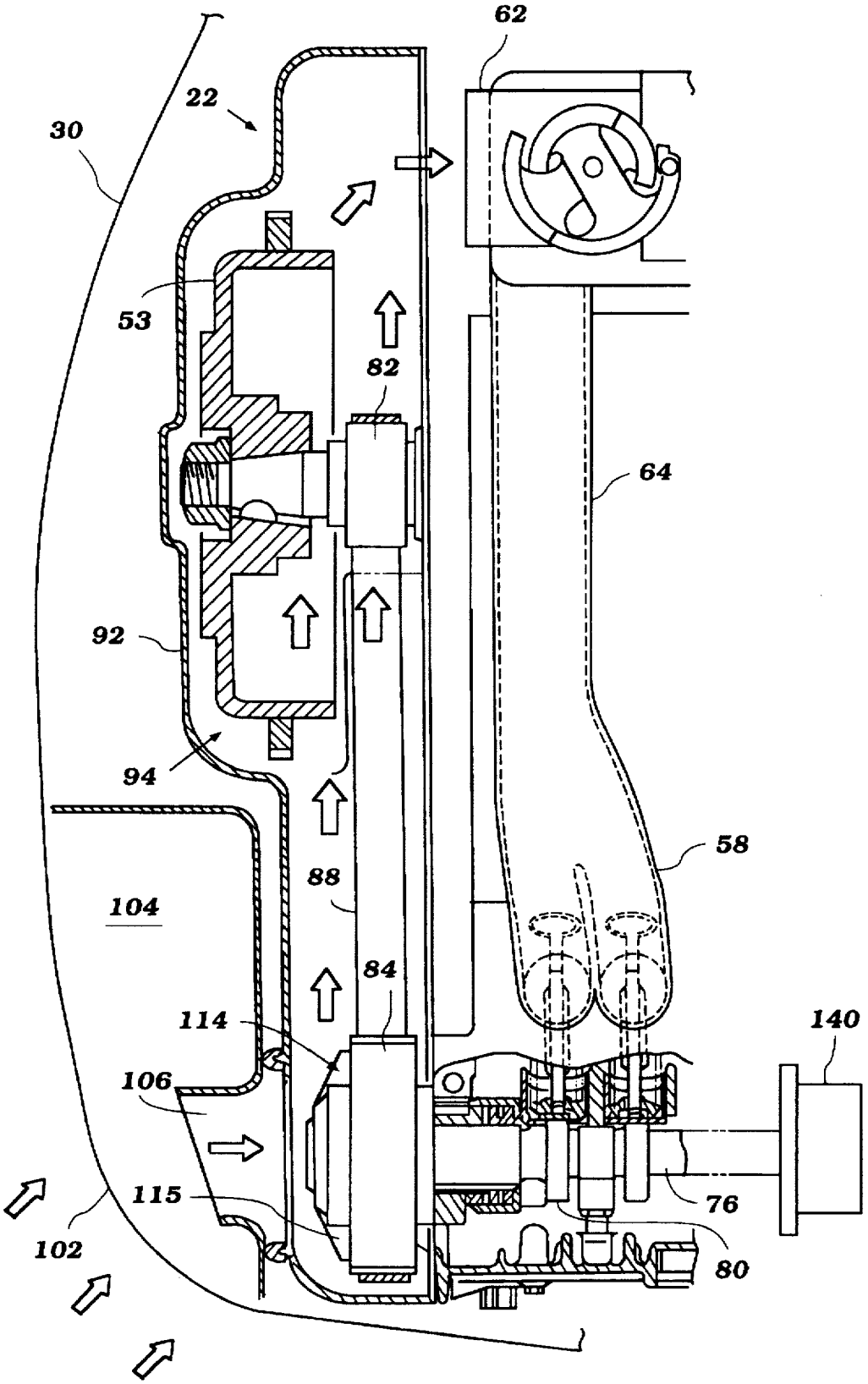
FIG. 4 is a first side view of the engine illustrated in FIG. 2, shown in cross-section therethrough.

A camshaft drive cooling system cover 92 extends over the belt 88 and sprockets 82,84,86. The cover 92 comprises a housing which is divided into two sections 94,96 by a baffle 98. The cover 92 is generally defined by an outer wall 100 which extends upwardly from the top end of the engine 22 around the sprockets 82,84,86. The wall 100 extends outwardly beyond the drive sprocket 82 over the inlet of the air intake plenum 62, as best illustrated in FIG. 4. The baffle 98 extends between the first and second camshafts 76,78 in a straight line to the crankshaft sprocket 82, and then extends across in diagonal fashion to the outer wall 100. The baffle 98 is positioned below the drive belt 88, close to the engine block 44.

As best illustrated in FIG. 4, the first or intake section 94 of the cover 92 is in communication with an outside air source. In particular, air is dram from outside the cowling 30 through vents 102 positioned in the cowling. This air is drawn into an air inlet cavity 104 positioned just inside of the cowling. Preferably, the air inlet cavity 104 includes an air/water separator (not shown) as known to those skilled in the art.

An air inlet passage 106 extends between the air inlet cavity 104 and the first section 94 of the cover 92. As illustrated by the unshaded arrows, air drawn into this section 94 of the cover 92 travels through the section of the cover to an outlet 108 positioned adjacent the air inlet of the intake air plenum 62. A portion of the air passing through the outlet 108 is drawn into the intake air plenum 62 and into the engine 22.

Figure 5:
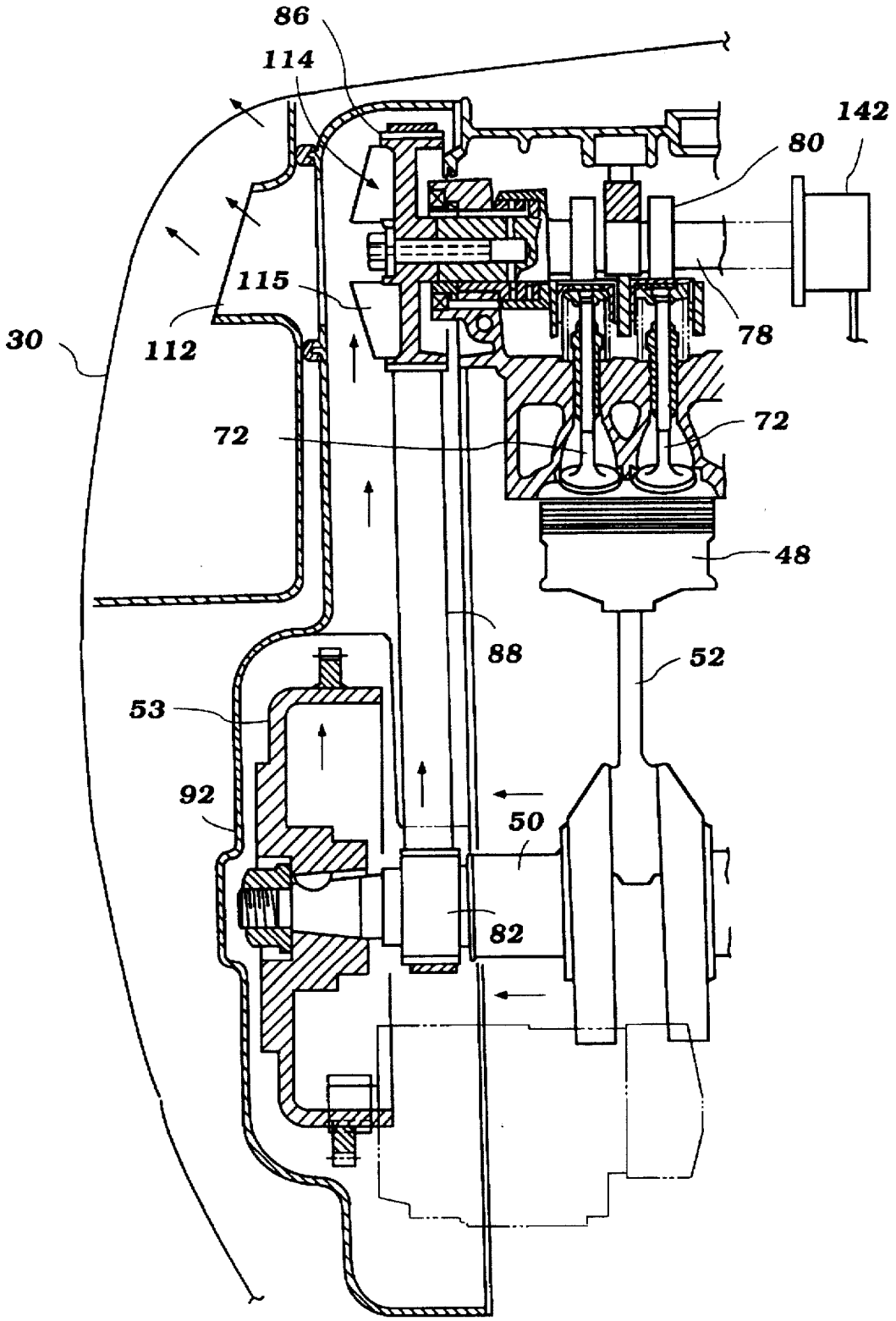
FIG. 5 is a second side view of the engine illustrated in FIG. 2, shown in cross-section therethrough.

Air which is not drawn into the intake air plenum 62 is drawn from adjacent the engine 22 into the second section 96 of the cover 92. As best illustrated in FIG. 5, the second section 96 is positioned opposite the first section 94, and leads from an intake area 110 to an air outlet 112. The outlet 112 is in communication with apertures in the cowling 30 for exhausting air therefrom. As illustrated by the shaded arrows in FIG. 5, heated air which was drawn through the first section 94 of the cover 92 and which was not drawn into the intake air plenum 62 is drawn through the second section 94 and exhausted through the outlet 112 to the exterior of the cowling.

As illustrated in FIG. 5, one or both of the cam sprockets 84,86 preferably drives a fan element 114. Preferably, the fan element 114 comprises a number of spaced vanes 115 positioned on the exterior face of the sprocket 84,86. The vanes 115 positioned on the intake cam sprocket 84 are oriented to draw fresh air from outside the cowling 30 into the first section 94 of the cover 92. The vanes 115 positioned on the exhaust cam sprocket 86 are oriented to draw heated air from within the cowling 30 and exhaust it out of the cowling. These fan elements 114 are useful in drawing cooler outside air across the camshaft drive mechanism 24 to keep it cool during engine operation.

In the orientation illustrated in FIG. 2, the crankshaft 50 preferably drives the sprocket 82 (and thus belt 88) connected thereto in a clockwise direction as viewed in this figure. When driven in this direction, the air inlet 106 and outlet 112 through the cover 92 are preferably arranged such that air is drawn through the cover 92 in the same direction as the belt 88 travels. Here, the fan element 114 driven by the first camshaft 76 is preferably arranged to draw air into the cover 92 from the air inlet 106, and the fan element 114 driven by the second camshaft 78 is arranged to push air out the air outlet 112. This arrangement has the benefit that the coolest air (i.e. that air just drawn into the cover 92) traverses the highest load area on the belt 88 (i.e. that portion of the belt 88 between the first camshaft 76 and where the belt 88 first engages the crankshaft sprocket 82) and is, therefore, most effective in cooling this portion of the belt 88.

As illustrated in FIG. 4, the second end of the first camshaft 76 (i.e. the end of the camshaft opposite the end which is driven by the belt 88) preferably drives a primary oil pump 140 for the engine 22. The end of the first camshaft 76 is directly coupled to the pump 140, whereby rotation of the first camshaft 76 by the crankshaft 50 through the belt 88 drives the pump 140 and lubricating oil is pumped throughout the engine 22.

As illustrated in FIG. 5, the second end of the second camshaft 78 (i.e. the end of the camshaft opposite the end which is driven by the belt 88) drives a distributor 142 of the engine 22. This end of the second camshaft 78 is directly coupled to the distributor 142, whereby rotation of the second camshaft 78 by the crankshaft 50 effectuates rotation of the distributor 142 for sending electrical firing pulses to the firing element (not shown) corresponding to each cylinder 46.

While the first camshaft 76 has been described as driving the oil pump 140 and the second camshaft 78 has been described as driving the distributor 142, one skilled in the art will appreciate that the exhaust camshaft could be utilized to drive the oil pump and the intake camshaft the distributor.

Figure 6:
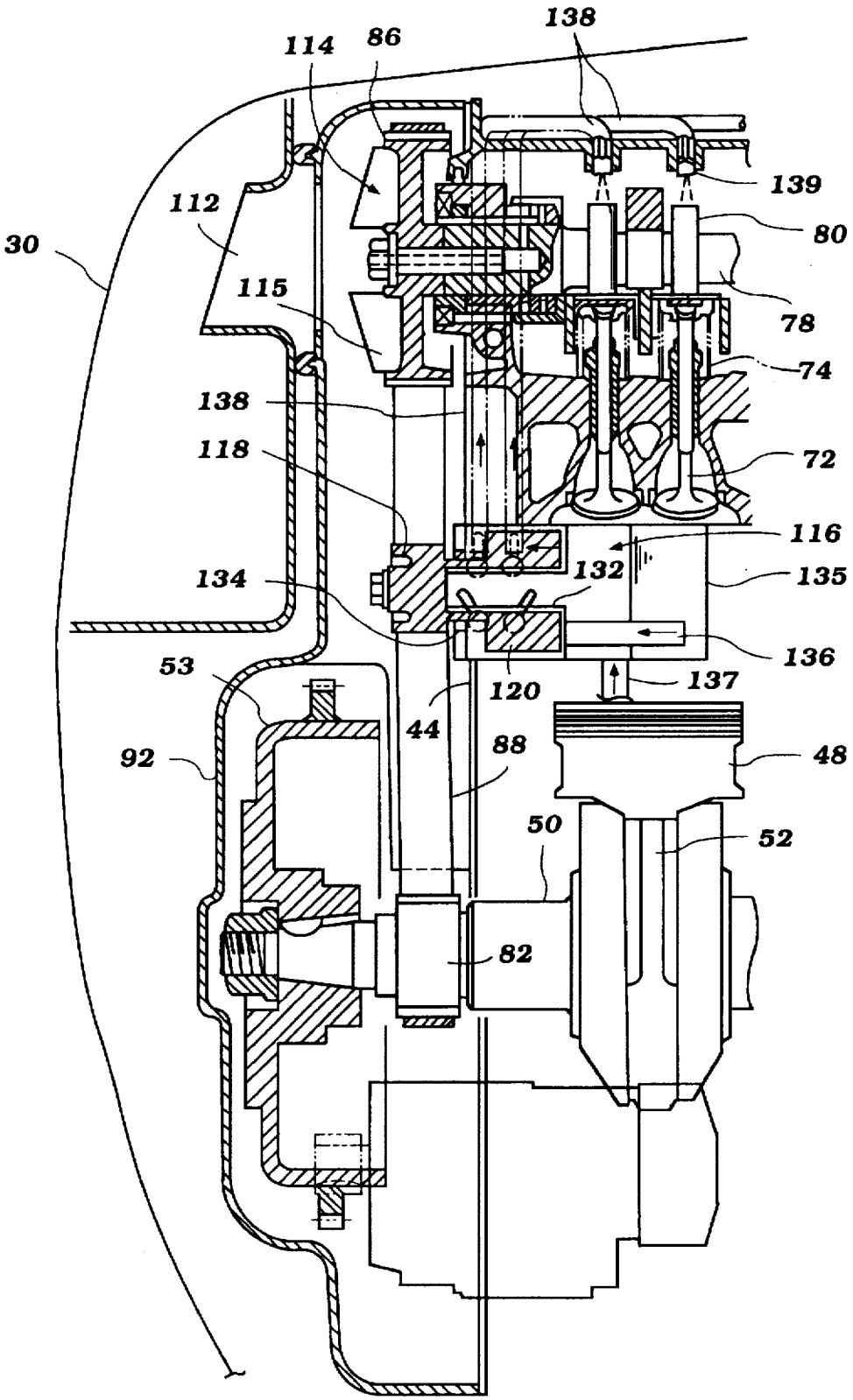
FIG. 6 is a side view of the engine illustrated in FIG. 2; including an idler driven by the flexible transmitter, the idler driving a secondary oil pump.
Figure 7:
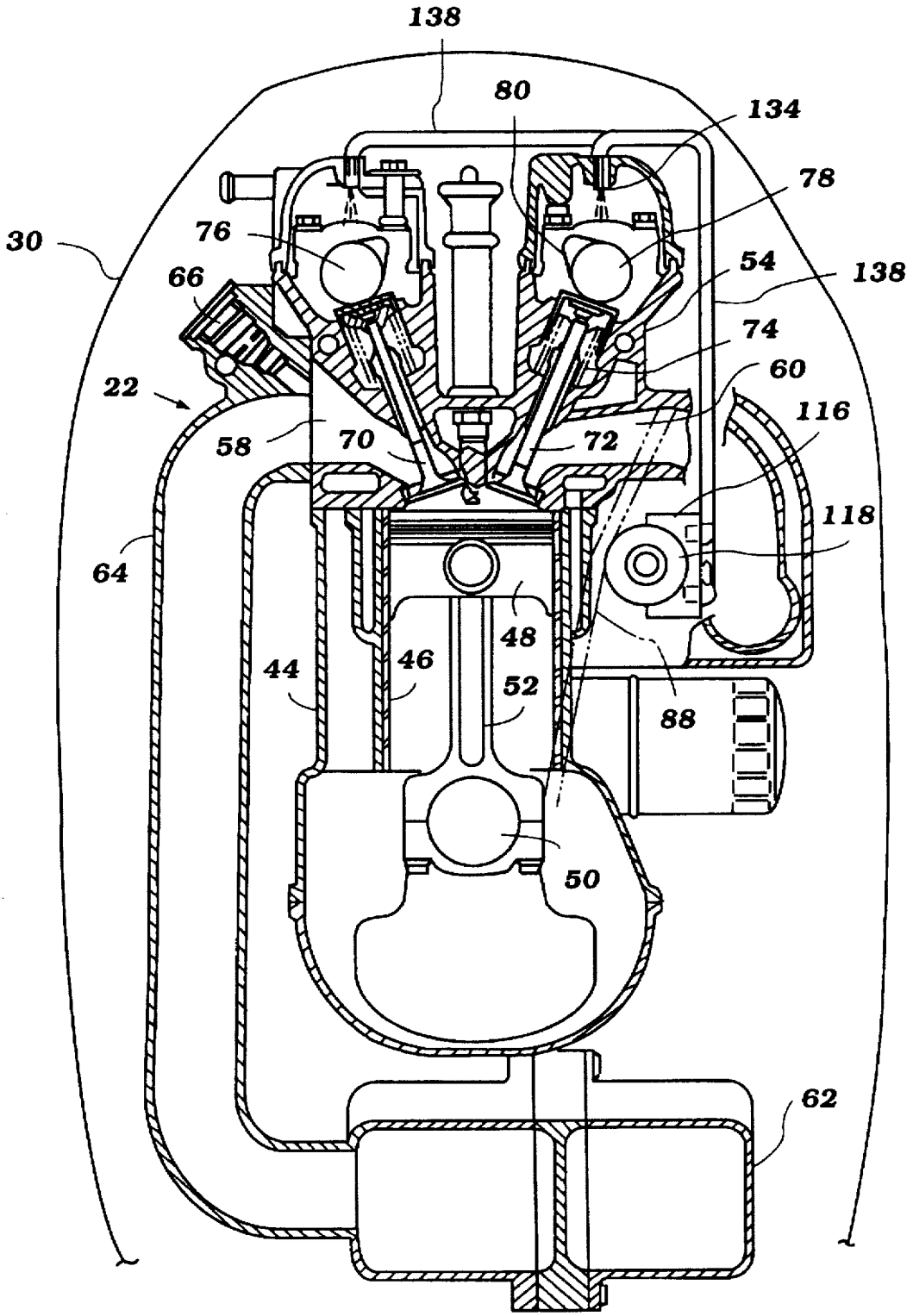
FIG. 7 is an end view of the engine illustrated in FIG. 6.

As illustrated in FIG. 6, the engine 22 preferably includes a secondary oil pump 116. This oil pump 116 is said to be "secondary" in that the engine 22 includes a primary or first oil pump, such as the oil pump 140 described above.

In the preferred arrangement, the camshaft drive mechanism 24 of the present invention powers the secondary oil pump 116 for supplying lubricating oil to one or more portions of the engine 22. In particular, an idler sprocket 118 is mounted in driving engagement with the belt 88. The idler sprocket 118, as best illustrated in FIG. 2, is preferably mounted in the first section 94 of the cover 92.

Referring again to FIG. 6, the idler sprocket 118 is in driving communication with a pump element 120 positioned within a pumping chamber 132 of the engine 22. The pumping element 120 is preferably of either the "trochoidal" or "gear" type. If of the gear-type, the pump element 120 comprises a pair of meshing gears which rotate in the pumping chamber 132, as is well-known to those skilled in the art. In this arrangement, the idler sprocket 118 drives, such as by direct connection of a drive shaft thereto, one of the gears of the pump. This gear in turn rotates the second gear of the pump, which has the effect of moving oil from one side of the chamber 132 to the other.

As illustrated, the pump 116 is of the "trochoidal" or rotor type. Here, the pumping element 120 includes an inner cross-shaped rotor which rotates within a star (i.e. five-point) shaped chamber of a larger outer rotor. The inner rotor is directly driven by the idler 118. The inner rotor drives the outer rotor, but at the same time moves with respect thereto within the chamber. Rotation of the rotor within the chamber of the outer rotor has the effect of moving oil from one side of the pumping chamber 132 to the other. These types of pumps are well-known to those skilled in the art.

At least one oil intake line 136 leads from a secondary oil tank 135 to the pumping chamber 132. Oil is supplied to the secondary oil tank 135 from a main oil passage 137. In addition, at least one oil outlet line 138 extends from the pumping chamber 132 to one or more discharge points. Preferably, and as illustrated in FIG. 6, the secondary oil pump 120 is positioned near the camshafts 76,78 of the engine 22 for supplying oil thereto. As such, a first oil outlet line 138 extends to the first camshaft 76, and a second outlet line 140 extends to the second camshaft 78. A number of discharge orifices 139 are provided for spraying the lubricating oil onto the camming surfaces 80 of the camshafts 76,78. The secondary oil pump 116 provides pressurized oil to the spray orifices 139.

This particular orientation of secondary oil pump 120 and oil supply lines 138,140 has the advantage that the portion of the camshafts 76,78 which are subjected to the highest load (i.e. the end of the camshafts driven by the belt 88) is provided with a high pressure supply of oil from the secondary oil pump 116. Also, a high-pressure oil supply is provided to the portion of the camshafts 76,78 which are positioned at the highest elevation of the engine 22. This area of the engine 22, by virtue of its elevation, would be an area in which the oil pressure would typically be low when using only a single pump.

Figure 8:
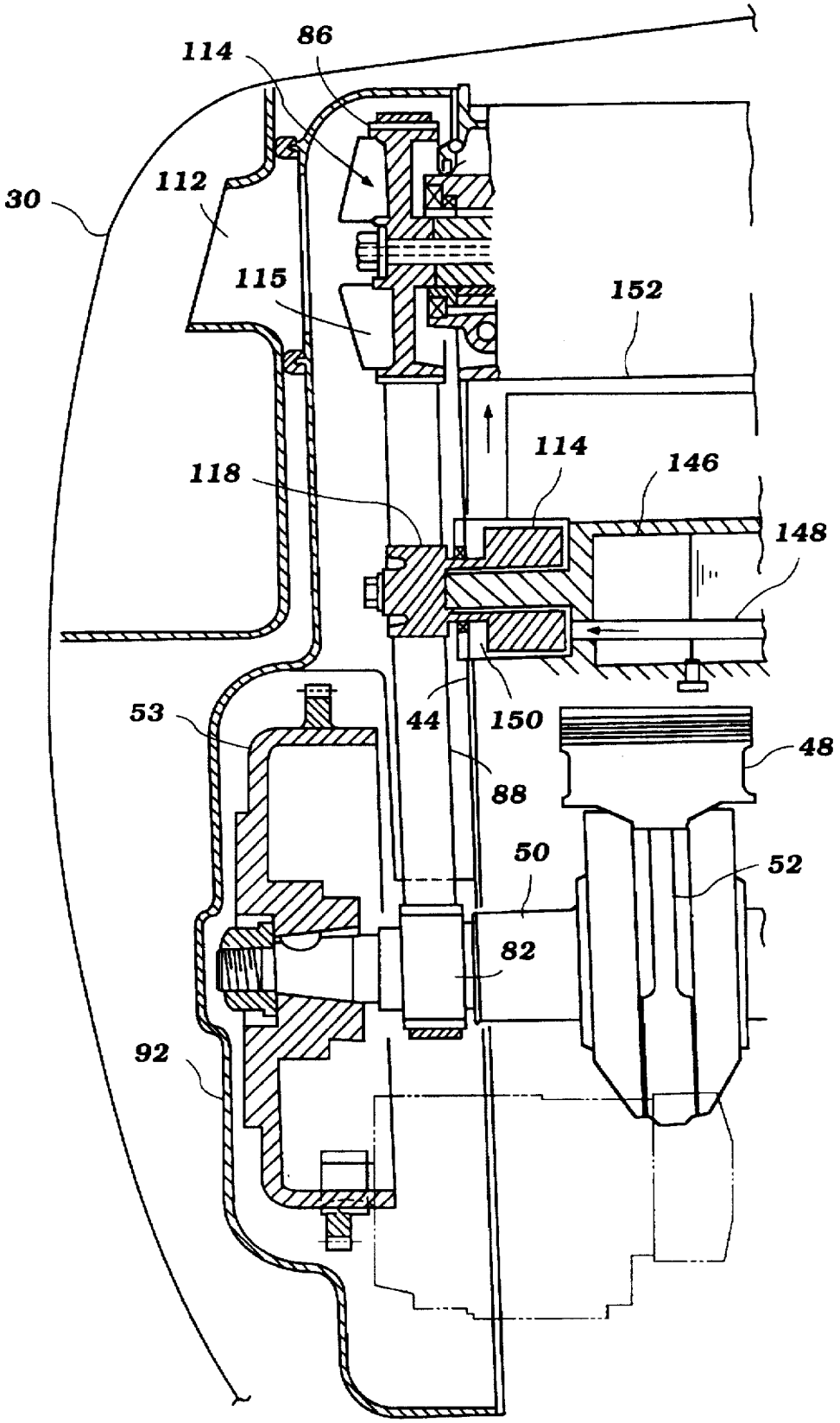
FIG. 8 is a side view of the engine illustrated in FIG. 2, including an idler driven by the flexible transmitter, the idler driving a coolant recirculation pump.

As illustrated in FIG. 8, the engine 22 may include a secondary coolant pump 144. This coolant pump 144 is said to be "secondary" because a primary or first coolant pump is preferably also provided. In the arrangement illustrated, the idler 118 drives the secondary coolant pump 144.

The secondary coolant pump 144 is powered in a manner similar to the secondary oil pump 120 disclosed above. Preferably, the coolant pump 144 comprises a radial impeller type pump which is rotatably positioned within a pumping chamber 150. The impeller is rotatably driven by an idler 118 arranged as described above.

The secondary coolant pump 144 pumps coolant from a coolant tank 146 via an inlet line 148. Coolant is supplied to the tank 146 by a primary coolant supply pump (not shown). The inlet line 148 extends into the pumping chamber 150. The pump 144 expels coolant from the pumping chamber 150 through an outlet 152 for circulating coolant throughout the engine 22.

In this arrangement, the secondary coolant pump 144 serves as a coolant distribution pump for the engine 22. In engines which have only one coolant pump, that pump must draw coolant from a lower inlet area and pump it up and distribute the coolant through the engine. The result may be that coolant pressure within the engine is less than desirable in one or more areas. In the present arrangement, the primary coolant pump supplies coolant (such as from a water inlet leading through the motor cowling of an outboard motor) to the coolant tank 146. From them, the secondary coolant pump 144 effectively pressurizes a supply of coolant for distribution throughout the engine 22.

Of course, the foregoing description is that of preferred embodiments of the invention, and various changes and modifications may be made without departing from the spirit and scope of the invention, as defined by the appended claims.

What is claimed is:

1. An engine having a block having a first end, an output shaft and at least a second shaft each journalled for rotation with respect to said block and each having an end extending from said first end thereof, a flexible transmitter mounted in communication with said output shaft and said second shaft, said flexible transmitter having a first portion moving in a first direction and at least a second portion moving in a generally opposite second direction, whereby said output shaft drives said second shaft, and a cover having an air inlet and air outlet, said cover defining a first air flow pathway from said air inlet in said first direction for cooling said first portion of said belt and defining a second air flow pathway in said second direction leading to said outlet for cooling said second portion of said belt.

2. The engine in accordance with claim 1, wherein said cover includes an outer wall defining an interior and wherein said cover further includes a baffle, said baffle dividing said interior into first and second areas defining said air flow pathways.

3. The engine in accordance with claim 1, wherein said second shaft comprises a camshaft and further including a third shaft, said third shaft also comprising a camshaft, said third shaft journalled for rotation with respect to said block and having an end extending therefrom, said third shaft also driven by said flexible transmitter.

4. The engine in accordance with claim 3, wherein a sprocket is mounted to the end of each of said output shaft, second shaft and third shaft extending outwardly of said first end of said engine, said flexible transmitter engaging said sprockets.

5. The engine in accordance with claim 3, wherein said first air flow pathway extends over said end of said second shaft extending from said first end of said engine, and wherein said second air flow pathway extends over said end of said third shaft extending from said first end of said engine.

6. The engine in accordance with claim 3, wherein an axis extends through the ends of said first and second shafts extending from said first end of said engine, and wherein said cover includes a baffle having at least one portion intersecting said axis between said ends of said first and second shafts.

7. The engine in accordance with claim 3, wherein said second shaft drives first means for moving air from said air inlet along said first air flow pathway and said third shaft drives second means for moving air along said second air flow pathway to said air outlet.

8. The engine in accordance with claim 7, wherein said first and second means for moving each comprise a fan element positioned on said end of said second and third shaft extending from said first end of said engine, respectively.

9. The engine in accordance with claim 1, wherein said second shaft drives means for moving air from said air inlet to said air outlet.

10. The engine in accordance with claim 1, wherein said engine is positioned within an engine enclosure and said air inlet is in communication with an engine enclosure air inlet and said air outlet is in communication with an engine enclosure air outlet.

11. The engine in accordance with claim 1, further including an air outlet at an opposite end of said first air flow pathway from said air inlet.

12. The engine in accordance with claim 11, wherein said engine includes an induction system having an inlet and said air outlet of said first air flow pathway leads to said inlet of said induction system.

13. The engine in accordance with claim 1, further including an air inlet at an opposite end of said second air flow pathway from said air outlet.

14. The engine in accordance with claim 13, wherein said air inlet of said second air flow pathway is in communication with a space surrounding said engine.

15. An outboard motor comprising an engine positioned within a cowling and a propulsion device driven by said engine, said engine having a cylinder block having a first end and a second end, an output shaft journalled to said cylinder block for rotation with respect thereto, said output shaft extending generally vertically and having a first end extending outwardly of the first end of said block and a second end extending outwardly of said second end of said block for driving said propulsion device, a cylinder head fixed relative to said block, a first camshaft journalled to said cylinder head for rotation with respect thereto and a second camshaft journalled to said cylinder head for rotation with respect thereto, a flexible transmitter mounted in driving communication with said first end of said crankshaft and a first end of each of said first and second camshafts whereby said crankshaft drives said first and second camshafts, and a cover, said cover comprising an outer wall having an air inlet and an air outlet therethrough and a baffle, said baffle cooperating with said outer wall to define a first air flow pathway from said air inlet across said first end of said engine for providing cooling air to cool a first portion of said belt and a second air flow pathway across said first end of said engine to said air outlet for providing cooling air to cool a second portion of said belt.

16. The outboard motor in accordance with claim 15, wherein said air inlet of said cover is in communication with an air inlet through said cowling and said air outlet of said cover is in communication with an air outlet through said cowling.

17. The outboard motor in accordance with claim 15, wherein at least one of said camshafts drives a means for moving air through said cover.

18. The outboard motor in accordance with claim 17, wherein said means for moving air comprises a fan element.

19. The outboard motor in accordance with claim 15, wherein at least a portion of said baffle extends from near said first end of said output shaft to a point between said first and second camshafts.

20. The outboard motor in accordance with claim 15, wherein said engine includes an air inlet plenum and said first air flow pathway extends to said plenum.

21. The outboard motor in accordance with claim 15, wherein a second end of either of said first or second camshafts drives a distributor.

22. The outboard motor in accordance with claim 15, wherein a second end of either said first or second camshafts drives an oil pump.

23. The engine in accordance with claim 12, wherein said means comprises a cover positioned adjacent said first end of said engine.

24. The outboard motor in accordance with claim 15, wherein said flexible belt further drives a sprocket which drives either a coolant or oil pump.

25. The engine in accordance with claim 24, wherein said cover comprises an outer wall defining an interior and including means for dividing said interior into first and second areas.

26. An engine having a block with a first end, an output shaft journalled with respect to said block and having a first end extending therefrom, a second shaft journalled with respect to said block and having a first end extending therefrom, a flexible transmitter in driving communication with said first end of said output shaft and said first end of said second shaft, said belt traversing a belt pathway from said output shaft to second shaft and back whereby said output shaft drives said second shaft, and means for defining a first cooling air flow path across a first portion of said belt pathway for cooling a first portion of said belt and a second cooling air flow path across a second portion of said belt pathway for cooling a second portion of said belt.

* * * * *